US007380790B2

(12) United States Patent
Farmer et al.

(10) Patent No.: US 7,380,790 B2
(45) Date of Patent: Jun. 3, 2008

(54) TRAILING EDGE ROTATING DEFLECTOR WITH CENTER PASSAGE FOR SHEET HANDLING APPARATUS

(75) Inventors: Geoffrey A. Farmer, Ingatestone (GB); Peter J. Watson, Rayleigh (GB); Keith G. R. Watts, Abbots Langley (GB)

(73) Assignee: Pitney Bowes Ltd., Harlow, Essex (GB)

( * ) Notice: Subject to any disclaimer, the term of this patent is extended or adjusted under 35 U.S.C. 154(b) by 311 days.

(21) Appl. No.: 11/033,942

(22) Filed: Jan. 12, 2005

(65) Prior Publication Data

US 2006/0151942 A1 Jul. 13, 2006

(51) Int. Cl.
*B65H 29/54* (2006.01)

(52) U.S. Cl. ..... 271/306; 271/264; 271/188; 198/369.1

(58) Field of Classification Search ..... 271/264, 271/270, 69, 306, 188, 189; 198/369.1, 369.2, 198/369.7
See application file for complete search history.

(56) References Cited

U.S. PATENT DOCUMENTS 4,549,645 A * 10/1985 Applegate ..... 198/408
5,244,200 A 9/1993 Manzke
5,655,761 A 8/1997 Sanchez
6,196,538 B1 * 3/2001 Stauber et al. ..... 271/69
6,220,591 B1 * 4/2001 Stauber ..... 271/225
6,969,059 B2 * 11/2005 Gafner ..... 271/69
7,124,877 B2 * 10/2006 Honegger ..... 198/608

FOREIGN PATENT DOCUMENTS

DE 19749610 C1 11/1998
EP 0768260 A2 10/1996

* cited by examiner

*Primary Examiner*—Patrick Mackey
*Assistant Examiner*—Gerald W McClain
(74) *Attorney, Agent, or Firm*—Ronald Reichman; Angelo N. Chaclas

(57) ABSTRACT

A sheet handling apparatus for feeding a sequential plurality of sheets having a sheet feed path for guiding sheets in a sheet feeding direction through the apparatus, the apparatus comprising rollers for driving sheets along the sheet feed path, and a trailing edge deflector deflecting means located on the sheet feed path, the trailing edge deflector being arranged to deflect the trailing edge of a leading sheet to ensure overlap by a following sheet on a predetermined side of the leading sheet.

3 Claims, 9 Drawing Sheets

TRAILING EDGE ROTATING DEFLECTOR WITH CENTER PASSAGE FOR SHEET HANDLING APPARATUS

FIELD OF THE INVENTION

This invention relates to a sheet deflector for use in an accumulator for sheet handling apparatus and is applicable to an apparatus and method for processing of elongate elements or articles, and in particular to an apparatus and method for selectively performing a plurality of operations on each of a number of different sheet or booklet elements, as well as envelopes.

BACKGROUND OF THE INVENTION

It is well known to provide a machine for successively performing several operations on various sheet elements. For example, operations on an envelope might include flapping, inserting, moistening and sealing, whilst operations on one or more sheets might include collating, folding and inserting into an envelope. It is further known to provide a machine which collates several sheets of paper into a bundle, folds the bundle, places an insert, such as a leaflet or booklet into the bundle, provides an envelope which is held open, inserts the folded sheets into the envelope, moistens the envelope and seals it, before ejecting the envelope into a receiving tray or bin. Each of these operations is distinct and requires a separate and unique processing region within the machine in order to successfully and repeatably carry out the required operation on the respective element. As a result, folder/inserter machines of the type described hereinbefore are typically large and complicated to program.

Recently, there have been moves towards reducing the size of such folder inserter machines in order to make them more accessible to smaller businesses, such as SOHO (small office/home office) operations. In order to be successful in this environment, the folder/inserter must occupy a small footprint (i.e. the area of floor/desk-surface occupied), perform reliably, and be easy to control without requiring specialist training.

GB-A-2380157 discloses a small office folder/inserter having two trays, and for storing sheets to be folded and the other for storing inserts to be inserted into the sheets. One location is specified for folding said sheets, another location for placing the insert into the folded sheets, and a further location for inserting the folded bundle into an envelope. The machine further comprises a location for storing envelopes, means for opening said envelopes and holding the envelopes open to receive the folded bundle at the inserting location, a section for moistening the flap of the envelope and a section for closing the flap of the envelope to seal it and ejecting the envelope to a receiving tray. Because of the small size and compactness of the machine, it is suitable for performing only a limited number of cycles in a given time period, i.e. it does not have a very high-volume throughput. Further, such machines can lack versatility, since they are suitable only for performing the respective feeding, folding, inserting, envelope opening, envelope moistening and sealing operations on a limited range of sizes of sheets/inserts.

Large organizations, such as banks, telephone companies, supermarket chains and the government, for example, are often required to produce extremely large throughputs of specifically-addressed mail to a regional or national audience. Machines capable of producing the high volumes required, whilst simultaneously accurately ensuring that the correct content is sent to the individual recipients, are typically very large, often occupying an entire warehouse. By contrast, existing small office equipment is typically capable of producing mailshots for a few hundred to one or two thousand addressees.

Demand, therefore, exists for a machine of intermediate production capacity, typically for small to regional businesses, which does not occupy a vast quantity of the available office space. Particularly in large cities, office space is charged at premium rates for each square metre. As such, the cost of running and maintaining a folder/inserter will also comprise the cost of renting the office space which it occupies.

For folder/inserter apparatuses intended for small and medium sized businesses, it is at least desirable, if not necessary, for the machine to be able to accommodate a range of different materials. For example, it will be necessary to accommodate different thicknesses of sheet element, as well as different sizes and numbers thereof. Similarly, any materials to be inserted within a folded package might range from a compliments slip to an entire booklet, including inserts of unconventional size or shape. It is also advantageous for such machines to be able to accommodate different sizes of envelopes, such as A4 and A5, depending on the material to be inserted thereinto.

SUMMARY OF THE INVENTION

According to one aspect of the present invention, there is provided a sheet handling apparatus for feeding a sequential plurality of sheets comprising: a sheet feed path for guiding sheets in a sheet feeding direction through the apparatus; driving means for driving sheets along the sheet feed path; and trail edge deflecting means located on the sheet feed path, the trail edge deflecting means being arranged to deflect the trailing edge of a leading sheet to ensure overlap by a following sheet on a predetermined side of the leading sheet.

According to a second aspect of the invention, there is provided a method of sheet handling in which a plurality of sheets are successively fed to an overlapping station, and the trailing edge of each sheet is deflected laterally to ensure correct ordering in the overlapping station.

BRIEF DESCRIPTION OF THE DRAWINGS

For a better understanding of the invention and to show how the same may be carried into effect, reference will now be made, by way of example, to the accompanying drawings, in which.

DETAILED DESCRIPTION OF THE INVENTION

Throughout the drawings, like numerals are used to identify like components.

Figure 1:
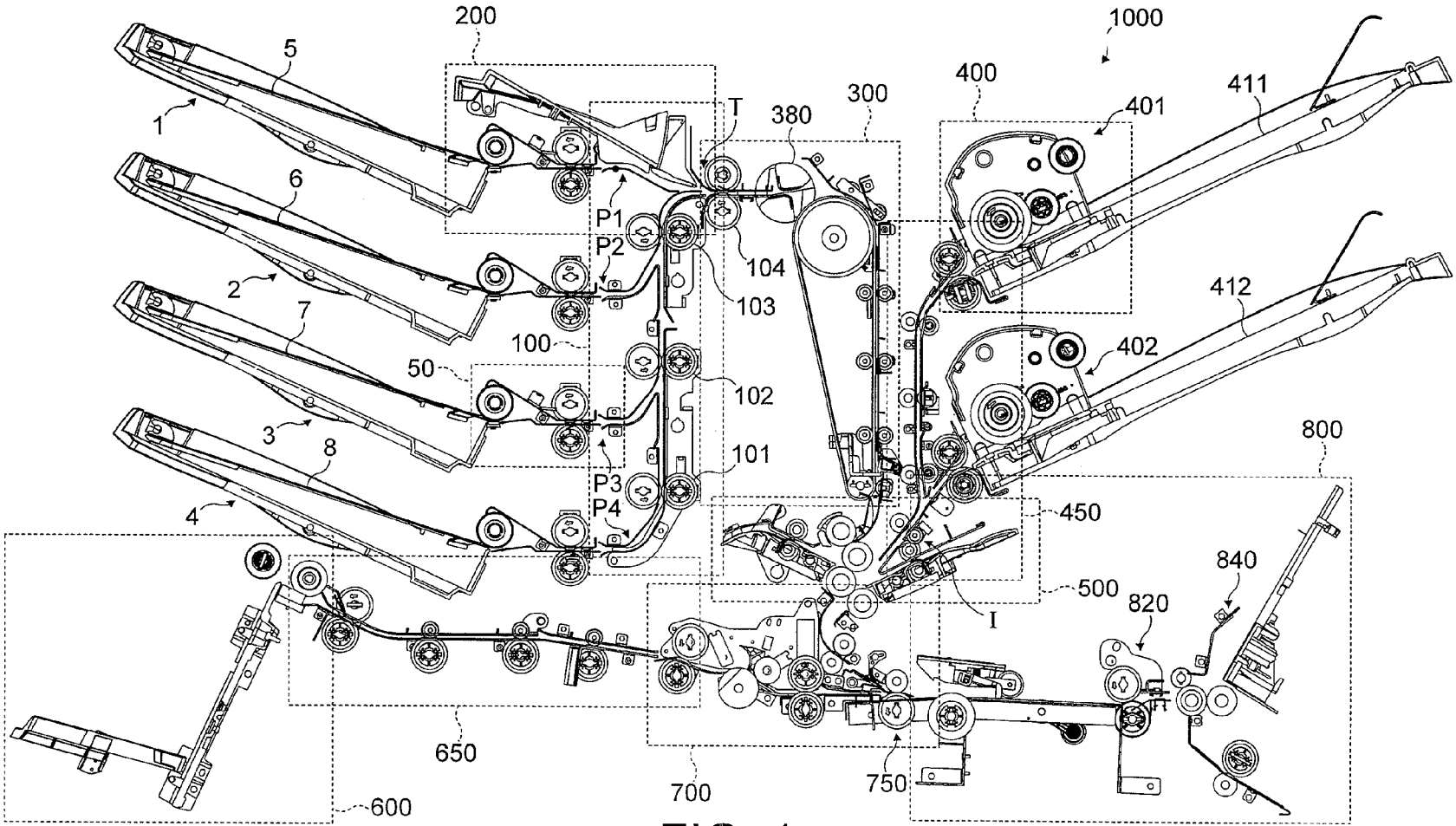
FIG. 1 is a cross-sectional view of a sheet handling apparatus detailing the different machine sections.

FIG. 1 shows a folder/inserter apparatus 1000 embodying the present invention. This embodiment is exemplary only, and is used to highlight and explain the inventive concept defined by the appended claims.

FIG. 1 shows a cross-sectional view of the folder/inserter apparatus 1000 and schematically shows various sections of the machine. The folder/inserter apparatus 1000 comprises a sheet feeder section including sheet feeders 1, 2, 3 and 4, from which sheets are fed into a collation section 100 where they are collated into an ordered paper stream. The paper stream is then fed along a sheet feed path which merges with an inlet from a convenience feeder 200, which acts as an alternative sheet feeder for certain documents. The sheets then pass through an accumulator section 300 where they are grouped together as an ordered and aligned package. From the accumulator, the sheets pass through a sheet folder 500. Inserts fed from insert feeders 401 and 402 are collated in an insert feeder collation section 450 and then fed into a folded collation. An envelope is fed from an envelope feeder 600 along an envelope transport path 650 to a flapper 700 where the envelope flap is opened and the mouth of the envelope held open at insertion section 750 to receive the folded collation. The collation is inserted into the envelope and the envelope is fed into a final section 800 where the gum on the envelope flap is moistened and the envelope sealed. The sealed envelope is then ejected into a receiving tray or bin.

Referring now to FIG. 1 in more detail, there is shown an inlet section which includes four sheet feeders 1, 2, 3 and 4. Each of these sheet feeders comprises a respective sheet feeder tray 5,6,7 or 8 into which a stack of sheets may be placed. The sheets in each tray are fed individually into a sheet feed path by respective sheet deskew mechanisms 50 which each act to separate a single sheet from the top of a stack of sheets in the associated sheet feeder tray and to feed the separated sheet into and along the sheet feed path. Four deskew mechanisms 50 are shown in FIG. 1, only one of which is identified by reference numeral 50 in FIG. 1. The other three deskew mechanisms are either identical or equivalent to that labelled 50. Each of the sheet feeder deskew mechanisms feeds into a common sheet feed path via respective sheet feeding inlet paths P1,P2,P3 and P4. The convenience feeder 200 similarly feeds into the common sheet feed path. All inlets to the sheet feed path from the four sheet feeders and from the convenience feeder 200 merge by a point T within the sheet feeder collation section 100. From the point T, the sheet feed path continues as a single sheet feed path up to the folder station 500. The sheet feed path passes first through the accumulator 300, where a plurality of sheets may be brought together to form an aligned and ordered package. The sheet feed path then passes through the sheet folding section 500 which produces a desired fold pattern in the accumulated document. As shown on the righthand side of FIG. 1, a pair of insert feeders 401, 402 are provided. Each insert feeder 401, 402 has a respective feeder tray 411, 412 which holds a plurality of inserts to be inserted into the folded collation. Each insert feeder further has an associated feeder device 400 for feeding a single insert into the insert collation section 450. Inserts fed into the insert collation section 450 are collated together and then inserted into the main folded collation. On the lefthand side of FIG. 1 below the sheet feeders 1,2,3 and 4 is located the envelope feeder 600. Envelope feeder 600 holds a plurality of envelopes which are fed along the envelope transport path 650 and into the flapper mechanism 700. The flapper mechanism 700 opens the flap of each envelope and uses mechanical fingers to hold the mouth of the envelope apart at insertion section 750 in order to allow the folded sheets (and any inserts) to be projected into the envelope. The envelope, with inserted documents, then continues along the sheet feed path to the final section 800 in which the gum on the envelope flap is moistened and the flap is sealed. The sealed envelope is then ejected from the folder/inserter apparatus 1000.

The operation of the folder/inserter apparatus is now considered in more detail with reference to FIGS. 2 to 6.

Figure 2:
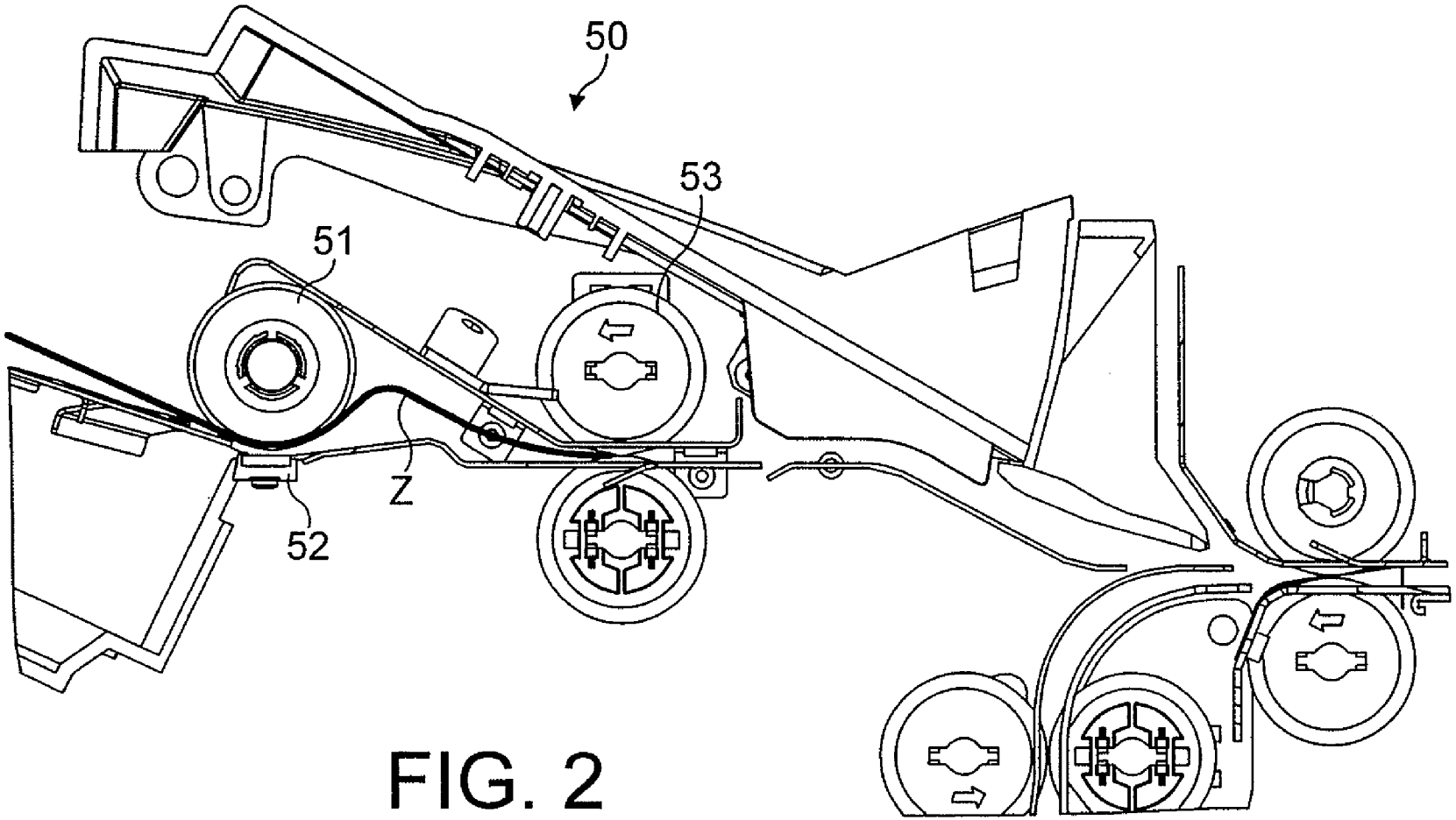
FIG. 2 is a cross-sectional view of a sheet feeder deskew mechanism.

Referring now to FIG. 2, the sheet feeder deskew mechanism 50 comprises a separator roller 51 which applies a driving force to the uppermost sheet in a stack in the sheet feeder tray. The separator roller 51 presses against a separator pad 52, normally in the form of a separator stone. This separator stone 52 prevents more than one sheet at a time from being fed into the sheet feed path by the roller 51. The single sheet removed from the sheet feeder tray by the separator roller 51 is then driven towards a deskew roller pair 53 which is maintained stationary. As the sheet engages the nip defined by the deskew roller pair 53 it is caused to buckle (as illustrated at Z). This forces the lead edge of the sheet to align with the nip of the deskew roller pair 53. The separator roller 51 is then stopped and the deskew roller pair 53 operated to drive the sheet along the sheet feed path and into the sheet feeder collation section 100.

Figure 3:
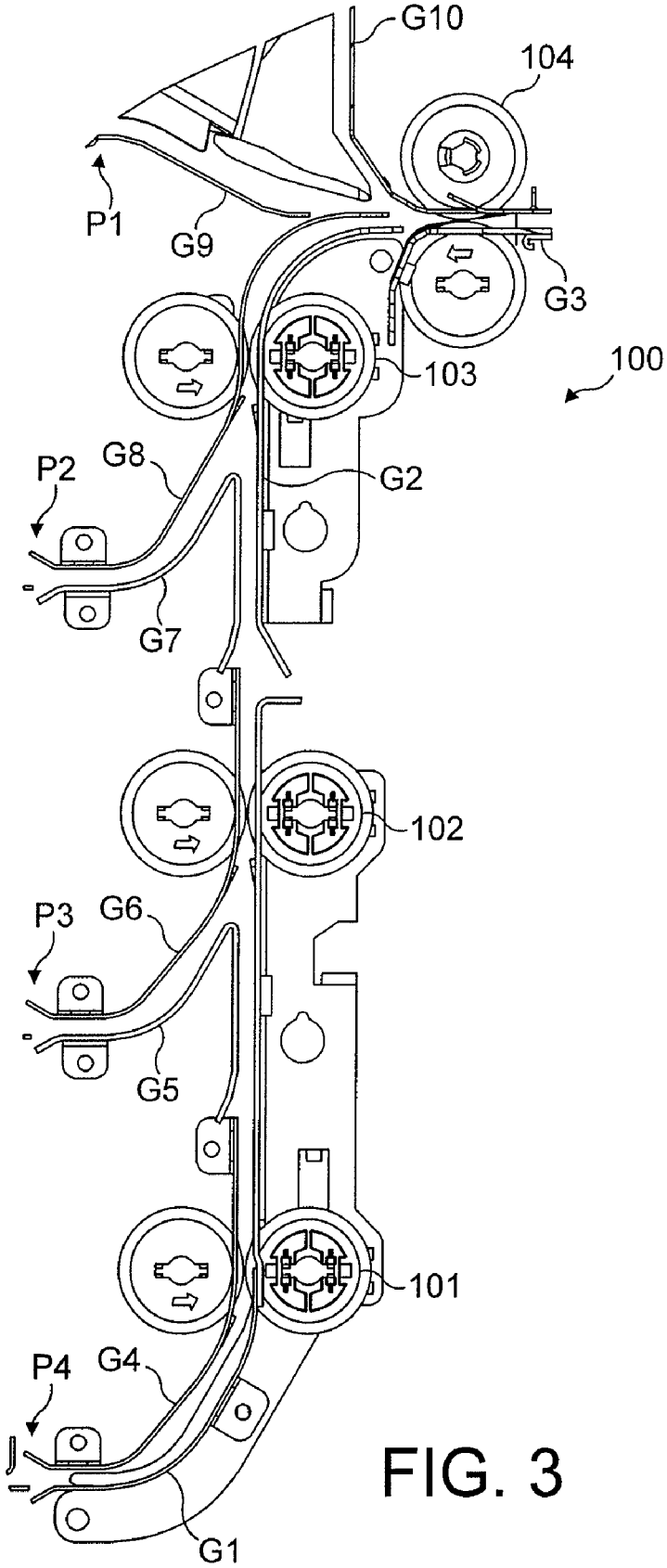
FIG. 3 is a cross-sectional view showing the sheet feeder collation section.

With reference to FIG. 3, each sheet fed from a sheet feeder 1,2,3 or 4 or convenience feeder is received in the respective sheet feeding inlet path P1,P2, P3, P4 or P5 defined by guides G1 and G4 to G10. The sheet feeding inlet paths merge into a single sheet feed path in the sheet feeder collation section 100. Sheet feeding roller pairs 101,102,103 and 104 are located along the sheet feed path for forcing the sheets along the sheet feed path.

In a typical sheet folding/inserting operation involving a four-page document, referring also to FIG. 1, the first sheet feeder tray 5 receives a stack of sheets corresponding to page 1 of the document, the second sheet feeder tray 6 receives a stack of sheets corresponding to page 2 of the document, the third sheet feeder tray 7 receives a stack of sheets corresponding to the page 3 of the document, whilst the fourth sheet feeder tray 8 receives a stack of sheets corresponding to page 4 of the document. A single sheet is then fed sequentially from each of the first to fourth sheet feeders. The first sheet from the first sheet feeder 1 passes into and along the sheet feeding inlet path P1 and partially along the common sheet feed path. A sheet is then fed from the second sheet feeder 2 such that the leading edge of the second sheet partially overlaps the trailing edge of the first fed sheet within the sheet feeder collation section 100. Similarly, the third sheet is fed so that the leading edge of the third sheet partially overlaps the trailing edge of the second sheet, whilst the fourth sheet is fed so that its leading edge partially overlaps the trailing edge of the third sheet. This forms a collation of the sheets along the sheet feed path in the sheet feeder collation section 100. The guides G1 to G10 defining the sheet feed path are configured and arranged to ensure that, as the sheets are sequentially fed into the sheet feed path and carried to overlap as described above, they become correctly collated in the intended order.

Because the requirement is that the adjacent sheets in the sheet collation only partially overlap at the leading and trailing edges, it is possible to drive the sheet collation along the sheet feed path at high speed without requiring a complex control system to ensure that each of the sheets is correctly aligned with those adjacent to it. This enables a high-volume throughput of mail packages to be achieved.

Figure 4:
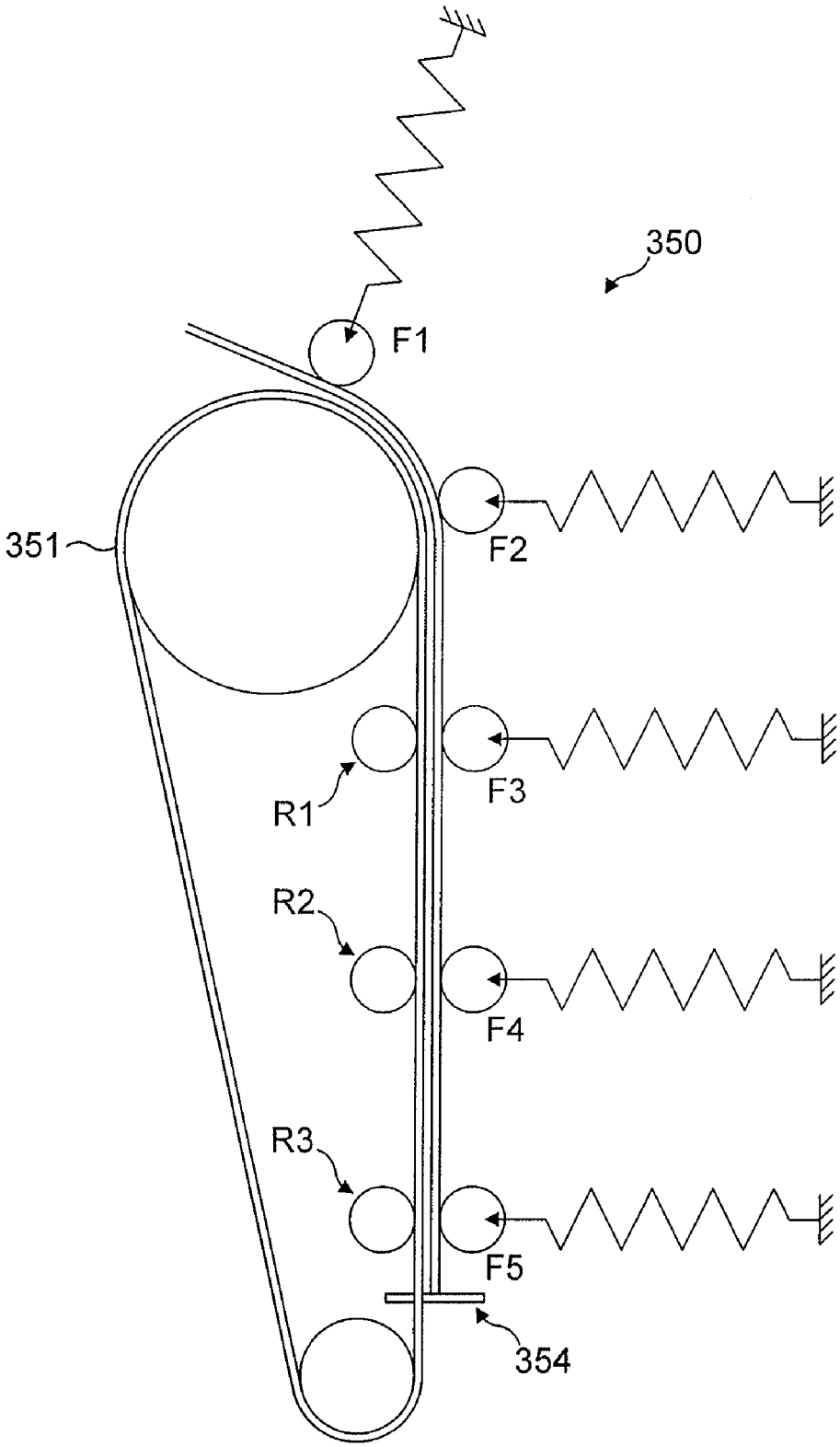
FIG. 4 is a schematic view of an accumulator according to an embodiment of the present invention.
Figure 5A:
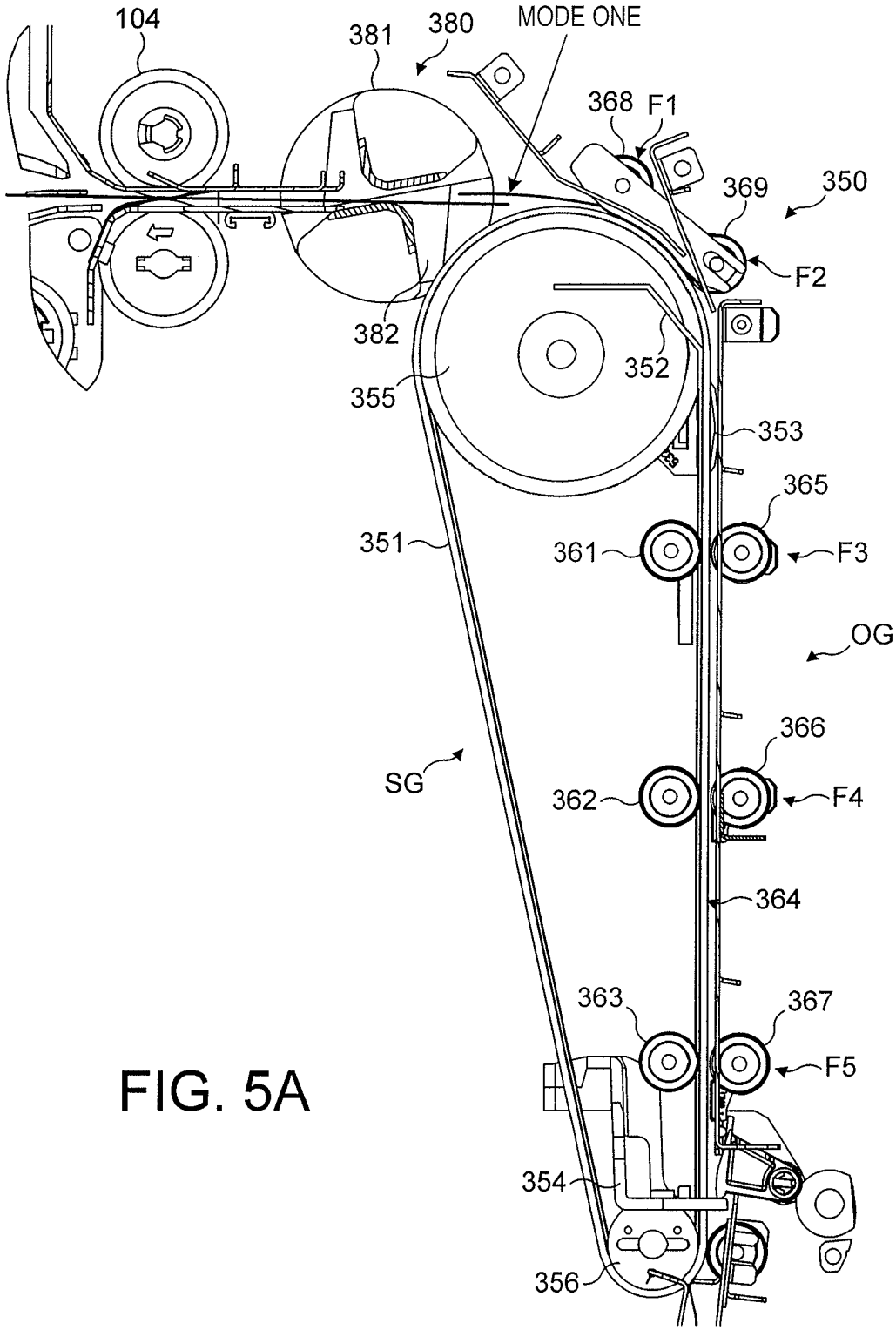
FIG. 5A is a cross-sectional view showing the accumulator installed in a sheet handling apparatus in mode one.
Figure 5B:
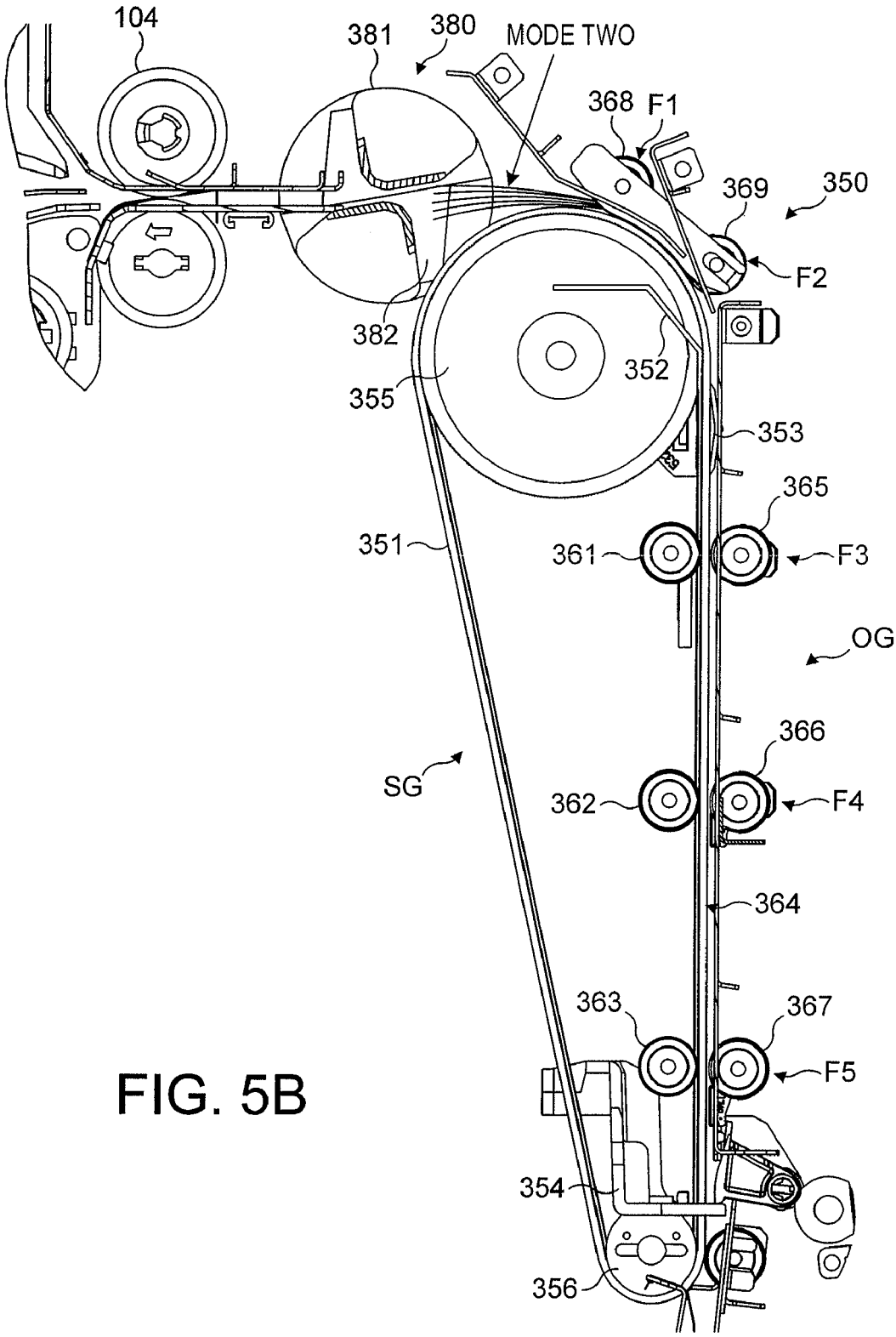
FIG. 5B is a cross-sectional view showing the accumulator installed in a sheet handling apparatus in mode two.
Figure 5C:
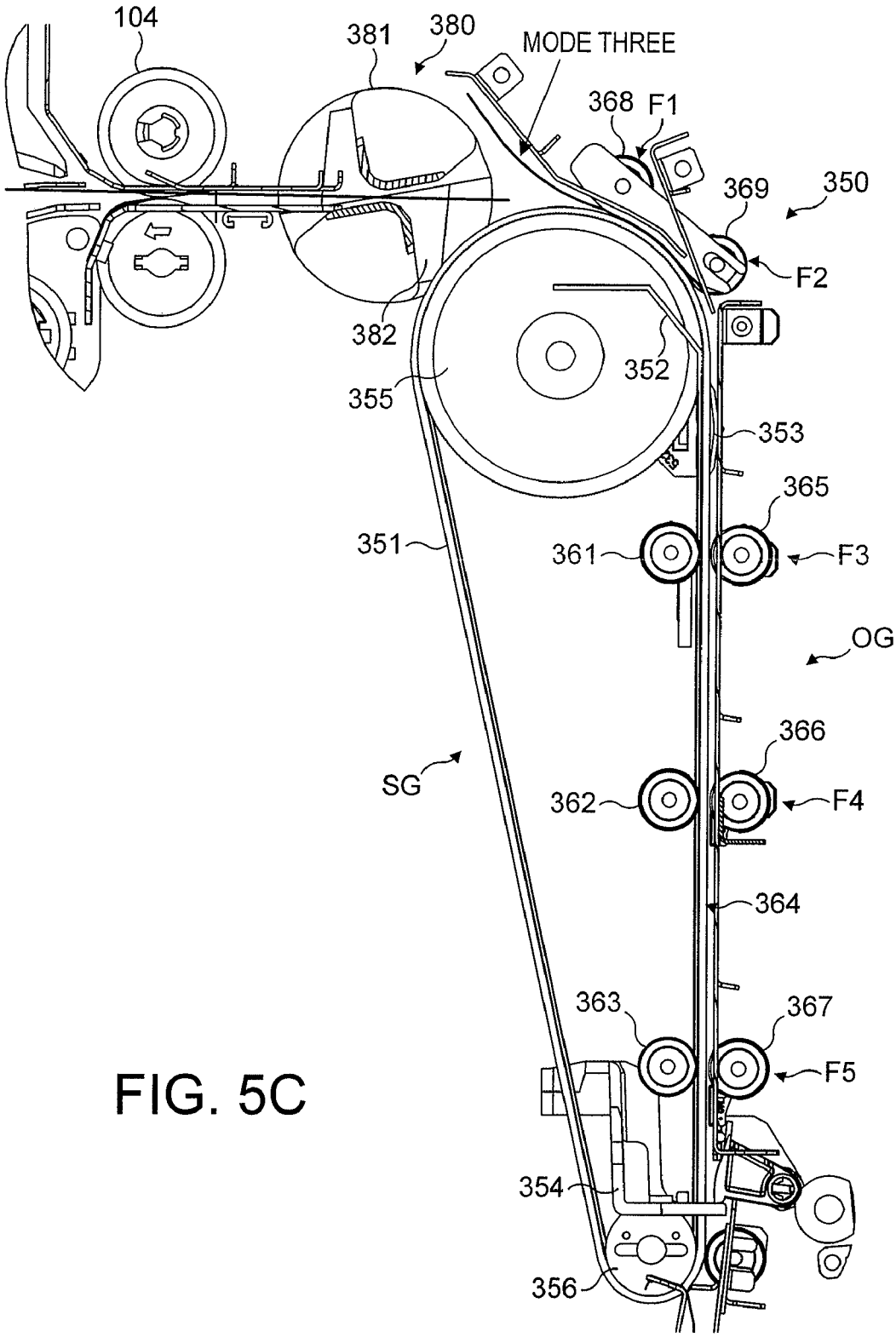
FIG. 5C is a cross-sectional view showing the accumulator installed in a sheet handling apparatus in mode three.
Figure 7:
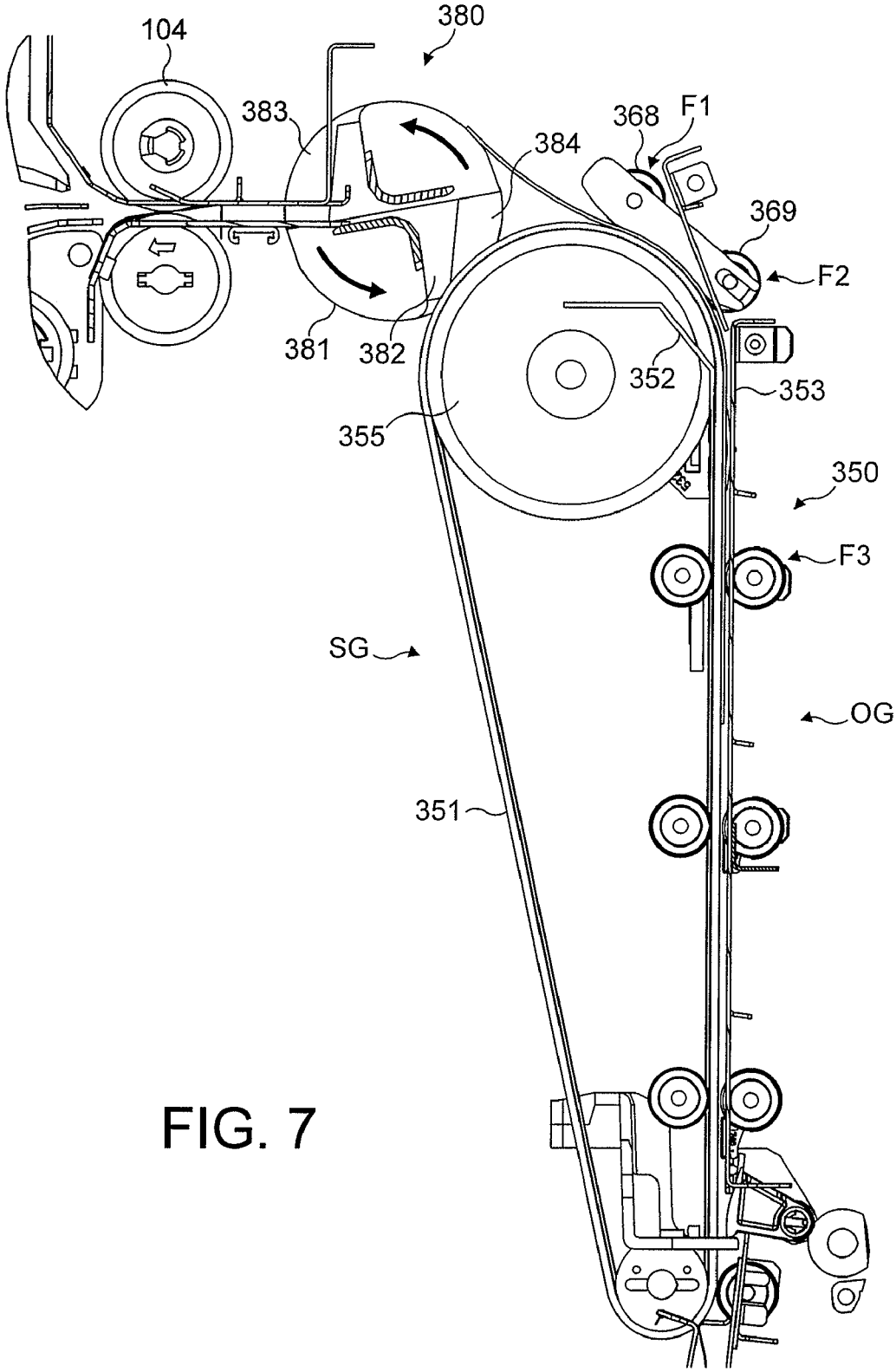
FIG. 7 shows a deflector according to one embodiment of the invention.

Referring now to FIGS. 4 and 5, the sheet collation is then driven from the collation section 100 into an accumulation section 300 comprising a vertical accumulator 350. Here, as each sheet arrives in the accumulator 350, it is gripped and forcibly advanced through the accumulator by a pair of traction belts 351 running vertically and mutually parallel on a sled 352 (as best shown in FIG. 7). A plurality of spring-biased idler rollers 365 to 369 are provided for each traction belt 351 to apply forces F1 to F5 to maintain the most recently-arrived sheet in contact with the tractions belts 351. Each sheet fed into the accumulator 350 arrives at an accumulation chamber 364 defined on one side by a sled guide assembly SG including the sled 352 and the traction belts 351 and on the other side by a fixed guide assembly OG including fixed guide 353 and idler rollers 365 to 367. The accumulation chamber 364 is substantially straight and vertical, such that the collation is accumulated into a vertical stack of sheets. At the bottom of the accumulation chamber 364 is an accumulation gate 354 functioning as a stopping device. Each sheet entering the accumulator 350 is driven downwardly through the accumulation chamber 364 towards the accumulation gate 354 by the traction belts 351 until its leading edge comes into contact with the accumulation gate 354. This causes the sheet leading edge to impinge on the accumulation gate 354 and the sheet to become correctly aligned within the accumulation chamber 364. The sheet is then maintained within the accumulation chamber 364 and rests on the accumulation gate 354, whilst further driving of the traction belts causes slippage between the traction belts 351 and the sheet. Thus, once the first sheet has been stopped by the accumulation gate 354, the second and subsequent sheets are consecutively driven into alignment with the first sheet by the traction belts 351 driving each sheet in turn along the accumulation path and against the accumulation gate 354 to form an ordered collation. When all of the sheets in the collation have been successfully grouped at the accumulation gate 354, the accumulation gate opens to allow the collation to progress out from the accumulation chamber 364 along the continuation of the sheet feed path.

Referring now to FIG. 5, it can be seen that the accumulator comprises the fixed guide assembly OG, and movable sled guide assembly SG. The movable guide assembly SG includes driving means in the form of the pair of traction belts 351. The fixed guide assembly OG includes idler rollers 365 to 367 for pressing the sheets to be accumulated against the traction belt 351 and rollers 361 to 363 for pressing the traction belt against the sheets to be accumulated. The movable guide assembly also includes the sled 352 for assisting guidance of the sheets, or collations of sheets, into an accumulated bundle whilst accommodating a variable thickness of accumulation. These features define a section of sheet feed path which is substantially vertical and acts as the accumulation chamber 364. In the embodiment shown, the means for driving the sheets downwardly towards the accumulation gate 354 is the pair of traction belts 351, although any suitable system of belts and rollers could be used. The present embodiment has two drive belt assemblies which each consist of one of the traction belts 351, a drive roller 355 and a secondary tension roller 356 which holds the traction belt 351 under tension, along with idler rollers 361, 362, 363 in the sled 352 acting in opposition to the idler rollers 365 to 367 in the fixed guide assembly. The idler rollers 365 to 367 associated with the fixed guide 353 could alternatively take the form of miniature drive belts biased towards the fixed idler rollers 361, 362,363 in the sled, but preferably sprung idler rollers are biased towards the traction belts. Further, idler rollers 368 and 369 are mounted on a further guide component positioned above guide 353 (see FIG. 5). The idler rollers 365 to 369 may be arranged to apply a force to the sheet which varies along the length of the accumulation chamber 364 and around the drive rollers 355 of the traction belt mechanisms 351. Such a variable traction force over the length of the accumulation chamber, preferably ensuring a larger force towards the bottom of the accumulation chamber, reduces the column strength of a sheet required to enable it to resist the frictional driving forces of the traction belts. In the present embodiment, the varied force is achieved by using sprung idler rollers 365, 366 and 367, each of which is biased towards the traction belts 351 by a different spring force, the spring force being largest for roller 367 and least for roller 365. The downward driving force is resisted at the bottom of the accumulator by the accumulation gate 354, but it is important that the traction forces from the driving means do not cause the individual sheets to buckle or concertina.

In traditional accumulators, the accumulated collation must be mechanically forced in order to propel it further along the sheet feed path. Because contact can be achieved only with the front and rear sheets at any time, the acceleration given to the accumulated collation must be limited in order to ensure that adjacent sheets do not slide relative to one another, thereby spreading apart the accumulated collation. As a result of the vertical orientation of the accumulation path in the present embodiment, a downward acceleration of 1 g (i.e. under gravitational force) can be achieved without mechanical forcing. In addition, using additional forcing methods, a further acceleration of 1 g may be imparted to the collation without resulting in the separation of adjacent sheets. Hence, accumulated collations emerging from the accumulator 350 of the present embodiment may be accelerated at roughly 2 g without resulting in sliding separation of the sheets. This allows for faster progression of the accumulated collation through the folder/inserter 1000, resulting in a higher-volume throughput of sheet packages.

Referring again to FIGS. 4 and 5, the operation of the accumulator 350 will be described in more detail.

As already outlined, as the sheet collation enters the accumulation section, the individual sheets are engaged by the pair of accumulator driving belts 351. At the accumulator inlet side, a pair of drive rollers 104 (FIG. 5) feeds the sheet material along the sheet feed path towards the drive belts 351. The drive belts 351 are stopped whilst the drive rollers 390 continue to feed a sheet into the accumulator 350. This allows subsequent sheets arriving after the first to be effectively overlapped with the sheet or sheets already in the accumulator 350 to ensure that they are engaged by driving means 351 and accumulated in the correct order.

According to the present embodiment, there are three methods by which a document may be fed into and accumulated in the accumulator. The first is as described above, where individual sheets are fed from the separate feed trays 1, 2, 3, 4 (FIG. 1), loosely collated in the sheet feeder collation section 100, and then accumulated in the accumulator 350. In this mode one (FIG. 5A), the sheets pass directly into the accumulation chamber in the correct order because they are already partially overlapped. As such, the second and subsequent sheets are always received between the sheet(s) already present in the accumulator and the traction belts 351, so that they are driven downwardly and accumulated against the accumulation gate 354 in the correct order.

The folder/inserter may also operate in two further modes for folding a mail piece and inserting it into an envelope. According to the second method mode 2 (FIG. 5B), pre-stapled sheets, for example a five-page document stapled in one corner, are placed in the convenience tray 200. This document is then fed directly to the accumulation chamber, where no further accumulation is required owing to the sheets being stapled. The document then exits the accumulation chamber and is folded and inserted as normal.

According to the third method of operation mode 3 (FIG. 5C), a plurality of ordered, loose sheets are placed in convenience feeder 200 or one of the sheet feeder trays 5, 6, 7 or 8 (FIG. 1). These sheets are fed successively one-at-a-time along the sheet feed path and into the accumulator. However, in this mode, the sheets are not partially overlapped in the paper feed path, and this leads to the risk that the sheets will become incorrectly ordered, or incorrectly fed into the accumulator, leading to mis-collated mail packages or a jam in the folder/inserter machine 1000.

To overcome this problem, a trail edge deflector 380 is provided, as shown in FIGS. 1, 5 and 7. In the third mode, the trail edge deflector 380 acts to lift the trail end of a sheet whose lead end is already in the accumulation chamber, to thereby ensure that the subsequent sheet to arrive is fed into the accumulator between the previous sheet and the traction belt. The trail edge deflector 380 comprises a roller 381 through which there is a passage 382 suitable for allowing one or a plurality of sheets to pass through the roller. The passage is flared at the inlet 383 and outlet 384 thereof to better accept the introduction of a sheet leading edge, to prevent jamming of the folder/inserter.

In the first and second modes the sheets or stapled document, etc. simply pass through the passage 382 in the roller 381 and into the accumulator 350.

In the third mode of operation, the sheets arriving individually pass part-way through the passage 382, and the leading edge of the sheet enters the accumulator 350 and is contacted by the traction belt 351 to drive it down against the accumulation gate 354. As the trail edge of each sheet reaches the trail edge deflector 380, the deflector rotates by 180° (anticlockwise as shown in FIG. 7). This forces the trail edge of that sheet upwards until it lies above the trail edge deflector 380. The inlet 383 and outlet 384 of the passage 382 through the roller 381 have then reversed positions and the subsequent sheet enters the passage through what was previously the outlet 384. This is possible because the passage 382 has a cross-section with rotational symmetry. The subsequent sheet is then guaranteed to be fed into the accumulator underneath the trail edge that was previously deflected, i.e. between the previous sheet and the traction belt 351.

This third mode of operation is particularly useful when, for example, a document has been printed by a laser jet printer and is collated in the correct order, and it is not desired to have to sort the individual pages of the document into the appropriate individual sheet feed trays.

After leaving the accumulator, the collation passes into the folding section 500 which contains a variable folding apparatus. The operation of such a folding apparatus is known, for example from GB-A-2380157. Brief explanation is given here for a more complete understanding.

Figure 6:
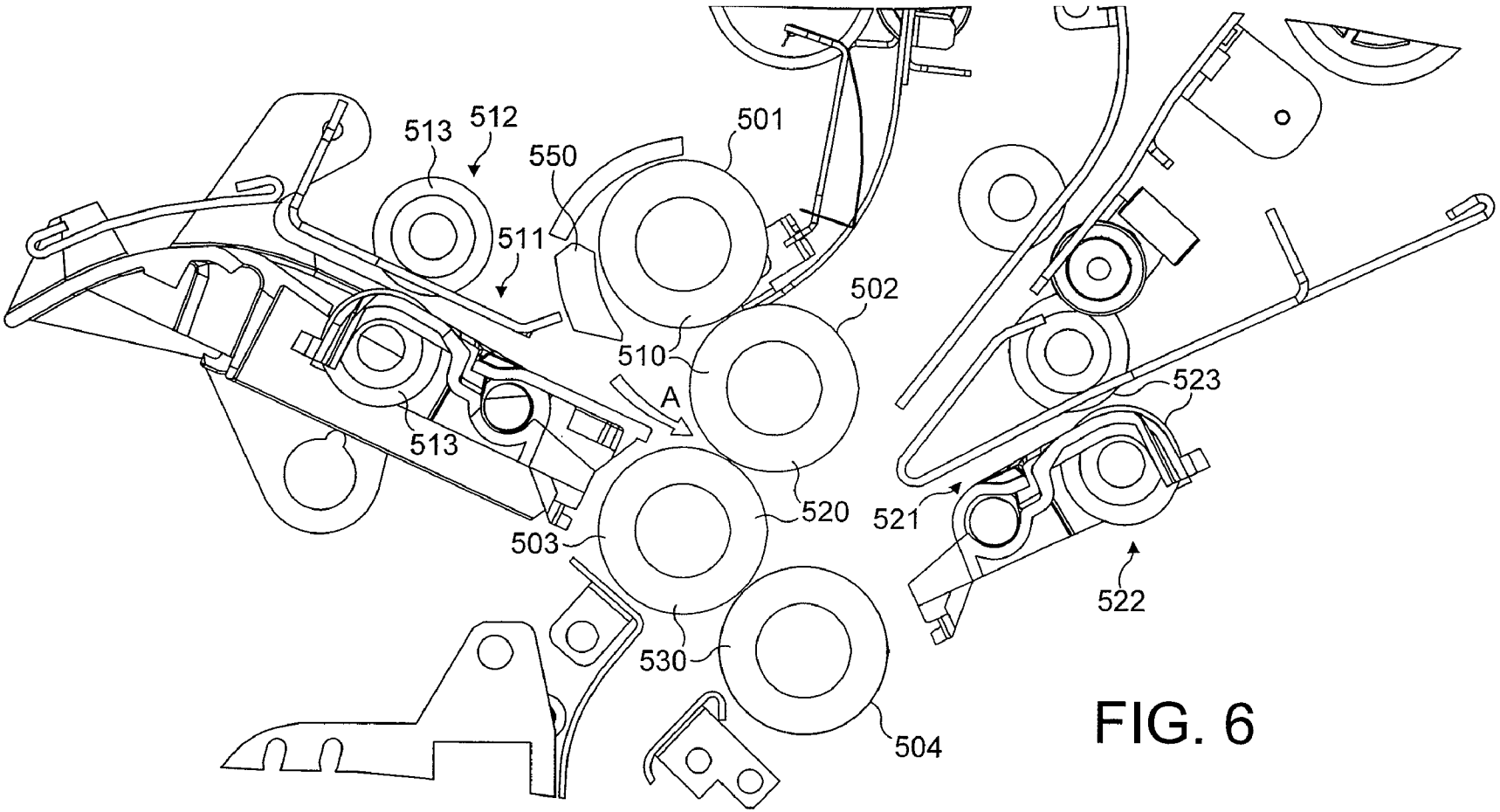
FIG. 6 is a cross-sectional view showing the sheet folding section.

Referring to FIG. 6, the folding apparatus comprises four rollers 501,502,503 and 504 arranged to form three pairs 510,520 and 530. The leading edge of the collation passes through the first roller pair 510 and into a buckle chute 511 until it reaches an adjustable stop 512, here constituted as a pinch roller pair 513 which selectively stops the collation based on detection of the leading edge position. At this point, the first roller pair continues to feed the sheet collation, causing it to buckle, and causing the buckled portion to enter the nip between the second roller pair 520. This results in the buckled portion being fed through the second roller pair 520 and forming a fold at the buckle, at a predetermined position. The folded edge then becomes the lead edge of the collation and it is fed through the second roller pair 520 into a second buckle chute 521 until it moves into contact with a second stop 522 (which is preferably a pinch roller pair 523) which halts its movement. The second roller pair 520 continues to feed the trailing edge of the sheet collation therethrough. Again, this causes the collation to buckle, and the second buckle is forced into the nip of the third roller pair 530, resulting in a second fold in the sheet collation at a predetermined point in the region of the second buckle.

By selectively determining the point at which the sheet collation is halted by the stops 512,522 at each stage, it is possible to always achieve the folds in the desired position. Further, by appropriately selecting the distance from the roller pairs at which the collation is halted, the same apparatus can selectively perform either a double fold, a "Z" fold or a "C" fold in the sheet collation. Equally, the sheet collation need only be folded a single time, for example simply folded in half. This single fold is achieved by operation of a half-fold mechanism 550. If a half-fold operation is selected, the half-fold mechanism 550 moves in the direction of arrow A to an interference position where it intercepts and redirects the accumulated collation as it exits the first roller pair 510. The collation is then directed immediately through the second roller pair 520, rather than into the first buckle chute 511. Accordingly, the first fold is never made in the collation at the nip of the second roller pair, and only a single fold is created as the collation is buckled in the second buckle chute 521 and the buckle passes through the third roller pair 530, as normal.

Referring again to FIG. 1, after the final fold is made, one or more inserts may be fed from insert feeders 401 and 402 shown on the right hand side of FIG. 1. The present embodiment has two insert feeders 401 and 402, which both feed an insert into and along an insert feed path. One or both inserts are then collated in the insert feeder collation section 450 and the collated inserts are held at insert staging area I whilst the sheets are folded. These collated inserts are then fed into the final fold in the sheet collation and form part of the folded document. Typically, these inserts might be booklets, business reply envelopes, compliment slips, product samples, etc. of varied shape, size, thickness and pliability.

Below the sheet feeders 1 to 4 is located the envelope feeder 600. This holds a plurality of envelopes in a stack, and has an associated mechanism for removing the single uppermost envelope from the stack and feeding said envelope along the envelope transport path 650. The envelope first undergoes a flapping process in flapper section 700, in which the flap is opened. The envelope is then held in the insertion region 750, where it is stopped. Mechanical fingers engage with and hold open the mouth of the envelope. In this state, the folded mail collation (including inserts) is inserted into the envelope by projecting the mail package towards the open mouth with sufficient velocity that its momentum will force it inside the envelope. This mail piece, comprising the folded mail package within the envelope, then proceeds to the sealing and ejection section 800. In the sealing and ejection section there is a moistening device 820 where the gum seal on the envelope flap is moistened. The envelope is then passed through a sealing/ejection mechanism 840. This performs a process which shuts and seals the moistened flap and ejects the envelope from the folder/inserter apparatus 1000 into a receiving tray or bin.

Although in the present embodiment the trailing edge deflector is described as a roller having a passage therethrough, the invention is not limited to this design, and any appropriate means for deflecting the trailing edges of the sheets may be employed.

Similarly, whilst it is preferred that the trailing edge of a first sheet is deflected prior to the arrival of a second sheet, it is to be noted that feasible embodiments could operate to deflect the trailing edge once partial overlap with the leading edge of the second sheet has occurred. Although such an embodiment is not shown in the drawings Figures, the claims are intended to cover such embodiments.

What is claimed is:

1. A sheet handling apparatus for feeding a sequential plurality of sheets comprising:

a sheet feed path for guiding sheets in a sheet feeding direction through the apparatus:

one or more rollers for driving sheets along the sheet feed path: and one or more deflectors located on the sheet feed path, a trailing edge of the deflector being arranged to deflect a trailing edge of a leading sheet to ensure overlap by a following sheet on a predetermined side of the leading sheet.

wherein the trailing edge of the deflector is rotated by the predetermined angle when the trailing edge of a sheet is in the passage to thereby deflect the trailing edge out of the sheet feed path, the passage then serving to guide the leading edge of the subsequent sheet directly through the passage along the sheet feed path to overlap with the deflected trailing edge and the trailing edge of the deflector has 180-degree rotational symmetry about a longitudinal axis, the predetermined angle being 180 degrees, so that when the deflector is rotated by the predetermined angle, the passage inlet becomes the passage outlet and the passage outlet becomes the passage inlet.

2. The sheet handling apparatus according to claim 1, wherein the passage inlet is flared at an opening.

3. The sheet handling apparatus according to claim 1, wherein the passage outlet is flared in the sheet feeding direction.

* * * * *